US012710180B2

(12) United States Patent
Kim et al.

(10) Patent No.: US 12,710,180 B2
(45) Date of Patent: Aug. 18, 2026

(54) COOKING APPARATUS

(71) Applicant: SAMSUNG ELECTRONICS CO., LTD., Suwon (JP)

(72) Inventors: Moonkyu Kim, Suwon-si (KR); Cheoleun Choi, Suwon-si (KR); Sihwan Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 511 days.

(21) Appl. No.: 18/327,500

(22) Filed: Jun. 1, 2023

(65) Prior Publication Data

US 2024/0035670 A1 Feb. 1, 2024

Related U.S. Application Data

(63) Continuation of application No. PCT/KR2023/006265, filed on May 9, 2023.

(30) Foreign Application Priority Data

Jul. 26, 2022 (KR) ..... 10-2022-0092798
Sep. 26, 2022 (KR) ..... 10-2022-0121983

(51) Int. Cl.
*F24C 15/02* (2006.01)
*F24C 15/04* (2006.01)
*F24C 15/34* (2006.01)

(52) U.S. Cl.
CPC ..... *F24C 15/028* (2013.01); *F24C 15/04* (2013.01); *F24C 15/34* (2013.01)

(58) Field of Classification Search
CPC ..... F24C 15/006; F24C 15/04; F24C 15/028; F24C 15/34; F24C 15/02
(Continued)

(56) References Cited

U.S. PATENT DOCUMENTS 3,996,710 A * 12/1976 Nuss ..... F24C 15/04 126/200
4,206,338 A 6/1980 Katona
(Continued)

FOREIGN PATENT DOCUMENTS

CN 203762916 U 8/2014
CN 208905569 U 5/2019
(Continued)

OTHER PUBLICATIONS

DE 102017220214 with Machine Translation (Year: 2019).*
(Continued)

*Primary Examiner* — Allen R. B. Schult
*Assistant Examiner* — Amy E Carter
(74) *Attorney, Agent, or Firm* — STAAS & HALSEY LLP

(57) ABSTRACT

A cooking apparatus may include a main body that includes a cooking room in which an opening is formed, the opening configured so that food may be put in and taken out of the cooking room through the opening, and to contain heat for cooking the food, and a door rotatably coupled to the main body and configured to open or close the opening. The door may include an outer glass that forms a front side of the door and faces outside the cooking room, an inner glass positioned behind the outer glass to face the cooking room, a door duct positioned between the outer glass and the inner glass and configured to guide air flowing between the outer glass and the inner glass to outside of the door, and a blocking member positioned an accommodating space formed between the door duct and the inner glass and configured to prevent heat contained in the cooking room from leaking out from between the inner glass and the door duct.

14 Claims, 13 Drawing Sheets

(58) Field of Classification Search
USPC ..... 126/198; 219/757
See application file for complete search history.

(56) References Cited

U.S. PATENT DOCUMENTS

| | | | | |
|---|---|---|---|---|
| 4,253,286 | A | 3/1981 | Katona | |
| 7,368,684 | B2 | 5/2008 | Kim et al. | |
| 10,648,676 | B2 | 5/2020 | Lee | |
| 2004/0159317 | A1* | 8/2004 | Walther | F24C 15/006 126/193 |
| 2007/0125760 | A1 | 6/2007 | Kim et al. | |
| 2013/0097937 | A1* | 4/2013 | Flasher | F16J 15/061 49/492.1 |
| 2016/0033143 | A1* | 2/2016 | Lee | F24C 15/006 126/198 |
| 2023/0221008 | A1* | 7/2023 | Bernauer | F24C 15/04 126/190 |

FOREIGN PATENT DOCUMENTS

| | | | | | |
|---|---|---|---|---|---|
| CN | 209733481 | U | | 12/2019 | |
| CN | 210891802 | U | | 6/2020 | |
| CN | 216984505 | U | | 7/2022 | |
| DE | 102012221622 | A1 | * | 5/2014 | F24C 15/045 |
| DE | 102017220214 | A1 | * | 5/2019 | F24C 15/04 |
| EP | 0 775 273 | B1 | | 5/2000 | |
| EP | 2592354 | A1 | * | 5/2013 | F24C 15/04 |
| EP | 1 972 855 | B1 | | 8/2013 | |
| EP | 2921782 | B1 | * | 7/2019 | F24C 15/04 |
| GB | 2013872 | A | * | 8/1979 | F24C 15/04 |
| KR | 10-0788810 | | | 12/2007 | |
| KR | 20160016478 | A | * | 2/2016 | F24C 15/028 |
| KR | 10-2017-0016580 | | | 2/2017 | |
| KR | 20170016580 | A | * | 2/2017 | F24C 15/34 |
| KR | 10-2413230 | | | 6/2022 | |

OTHER PUBLICATIONS

EP 2592354 with Machine Translation (Year: 2013).*
EP 2921782 with Machine Translation (Year: 2019).*
KR 20160016478 with Machine Translation (Year: 2016).*
Machine Translation of KR 20170016580 (Year: 2017).*
DE 102012221622 with Machine Translation (Year: 2014).*
International Search Report issued in International Application No. PCT/KR2023/006265 dated Aug. 17, 2023.
Written Opinion issued in International Application No. PCT/KR2023/006265 dated Aug. 17, 2023.

* cited by examiner

COOKING APPARATUS

CROSS-REFERENCE TO RELATED APPLICATIONS

This application is a continuation application of International Application No. PCT/KR2023/006265, filed on May 9, 2023, which claims priority to Korean Patent Application Nos. 10-2022-0092798, filed Jul. 26, 2022 and 10-2022-0121983, filed Sep. 26, 2022, the disclosures of which are each hereby incorporated by reference herein in their entirety.

BACKGROUND

1. Field

The present disclosure relates to a cooking apparatus having an improved structure capable of lowering a surface temperature of a door to a preset level or less.

2. Description of Related Art

A cooking apparatus, which is an apparatus for cooking a cooking material such as food by heating the cooking material, means an apparatus capable of providing various functions related to cooking, such as heating, defrosting, drying, sterilizing, etc. of a cooking material. Examples of the cooking apparatus include an oven, such as a gas oven or an electric oven, a microwave heating apparatus (hereinafter, referred to as a microwave), a gas range, an electric range, an Over The Range (OTR), a gas grill, an electric grill, etc.

In general, the oven is an appliance for cooking food by transferring heat directly to the food or heating the inside of the cooking room through a heating source such as a heater for generating heat, and the microwave is an appliance for cooking food with intermolecular friction heat generated by disturbing the molecular arrangement of the food using high frequency as a heating source.

The cooking apparatus includes a cooking room in which food is cooked, and a door for sealing the cooking room.

Because the door is a component exposed to users, the surface temperature of the door needs to be maintained at a preset level or less for safety reasons.

SUMMARY

A cooking apparatus according to an embodiment of the disclosure may include a main body that includes a cooking room in which an opening is formed, the opening configured to be capable of food to be put in and taken out of the cooking room through the opening, and to contain heat for cooking the food and a door rotatably coupled to the main body and configured to open or close the opening. The door may include an outer glass that forms a front side of the door. The door may include an inner glass positioned behind the outer glass to face the cooking room. The door may include a door duct positioned between the outer glass and the inner glass and configured to guide air flowing between the outer glass and the inner glass to outside of the door. The door may include a blocking member positioned in an accommodating space formed between the door duct and the inner glass and configured to prevent heat contained in the cooking room from leaking out between the inner glass and the door duct.

The door duct may include a first body positioned parallel to the and behind the outer glass, a second body bent from the first body and forming an upper surface of the door duct, a third body bent from the second body and formed with a communication hole configured so that air flowing between the outer glass and the inner glass is discharged outside the door, and a fourth body bent from the third body and extending to a rear portion of the inner glass.

The door may further include a duct bracket coupled to an inner surface of the third body of the door duct.

The duct bracket may include a bracket body, a duct coupling flange extending upward from the bracket body and coupled to the third body of the door duct, and a support flange extending downward from the bracket body and extending to a front portion of the inner glass.

The third body of the door duct and the support flange are configured to form the accommodating space to accommodate the blocking member.

The duct bracket may include a metal material configured to be welded onto the door duct.

The door may further include an adhesive member positioned on the door duct and configured to adhere the blocking member to the door duct so that the blocking member is positioned on an upper surface of the inner glass to seal a gap between the inner glass and the door duct.

The door may include an insulation member positioned between the door duct and the outer glass.

The insulation member may include an insulation body, and an elastic rib extending from the insulation body in a frontward direction toward the outer glass.

The door duct may include a first body positioned parallel and behind the outer glass, an insulating member insertion portion formed in the first body, and the insulation member may include a duct coupling protrusion protruding from the insulation body toward a rear direction and configured to be inserted in the insulation member inserting portion.

The door duct may include a first body positioned parallel and behind the outer glass, and the door may further include an adhesive member positioned on the first body and configured to adhere the insulation body to the door duct.

The door may further include a door frame on a side of the door on a rear surface of the outer glass and configured to support the door duct and the inner glass at the side.

The door duct may include a frame coupling portion extending downward from each end of the frame coupling portion, and the door frame includes a duct fastening portion configured to be coupled to the each end of frame coupling portion, and wherein when the duct fastening portion is coupled to the frame coupling portions, the blocking member may be compressed between the inner glass and the door duct.

The door may be not formed with a handle.

The blocking member may include a glass fiber material.

A cooking apparatus according to an embodiment of the disclosure may include a main body forming a cooking room. The cooking apparatus may include a door rotatably coupled to the main body and configured to open or close the cooking room.

The door may include an outer glass. The door may include a door duct positioned on an upper portion of the outer glass behind the outer glass. The door may include a duct bracket coupled to an inner surface of the door duct. The door may include an inner glass positioned behind the outer glass and facing the cooking room, wherein an upper end portion of the inner glass is positioned between the door duct and the duct bracket. The door may include a blocking member being in contact with an upper surface of the inner glass to prevent heat of the cooking room from leaking out, wherein the blocking member being compressible is positioned between the door duct and the duct bracket. The door may include an insulation member positioned between the door duct and the outer glass and configured to prevent heat of the door duct from being transferred to the outer glass.

The insulation member may include an insulation body and an elastic rib extending from the insulation body in a front direction toward the outer glass.

The door duct may include an insulation member inserting portion formed in a first body positioned in parallel to the outer glass behind the outer glass.

The insulation member may include a duct coupling protrusion protruding toward a rear direction from the insulation body to be inserted in the insulation member inserting portion.

A cooking apparatus according to an embodiment of the disclosure may include a main body forming a cooking room. The cooking apparatus may include a door rotatably coupled to the main body and configured to open or close the cooking room. The door may include an outer glass. The door may include an inner glass facing the cooking room behind the outer glass. The door may include a door duct positioned between the outer glass and the inner glass and configured to guide air cooled the door upward from the door. The door may include a blocking member positioned between the inner glass and the door duct and configured to prevent heat of the cooking room from leaking out between the inner glass and the door duct. The door may include an insulation member positioned between the door duct and the outer glass and configured to prevent heat of the door duct from being transferred to the outer glass.

The cooking apparatus may further include a duct bracket coupled to an inner surface of the door duct and extending to a front portion of the inner glass to support a front portion of the blocking member.

DETAILED DESCRIPTION

Figure 1:
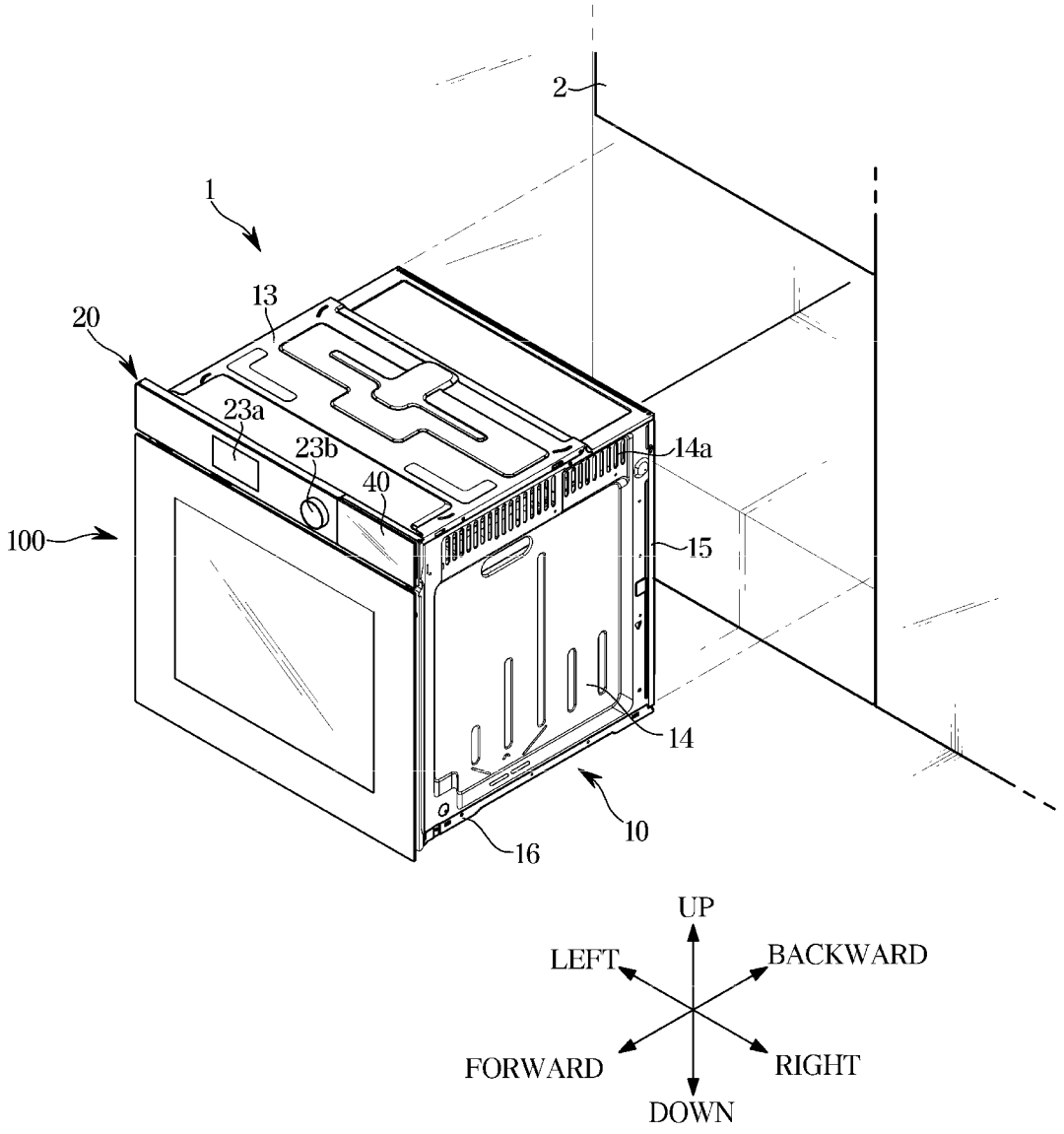
FIG. 1 is a perspective view of a cooking apparatus according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe the embodiments, and are not intended to limit and/or restrict the disclosure. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the disclosure. As used herein, the term "and/or" includes any and all combinations of one or more of associated listed items.

One aspect of the disclosure provides a cooking apparatus having an improved structure capable of further lowering a surface temperature of a door of the cooking apparatus.

By positioning the blocking member between the door duct and the inner glass, heat of the cooking room may be prevented from leaking to the outer glass.

By positioning the insulation member between the door duct and the outer glass, heat of the door duct may be prevented from being conducted to the outer glass.

Through components of the blocking member and the insulation member, a surface temperature of the door may be maintained at a preset level or less.

By securing a low surface temperature of the door, an exterior design of the door may be freely implemented.

Hereinafter, an embodiment of the disclosure will be described in detail with reference to the accompanying drawings.

Figure 2:
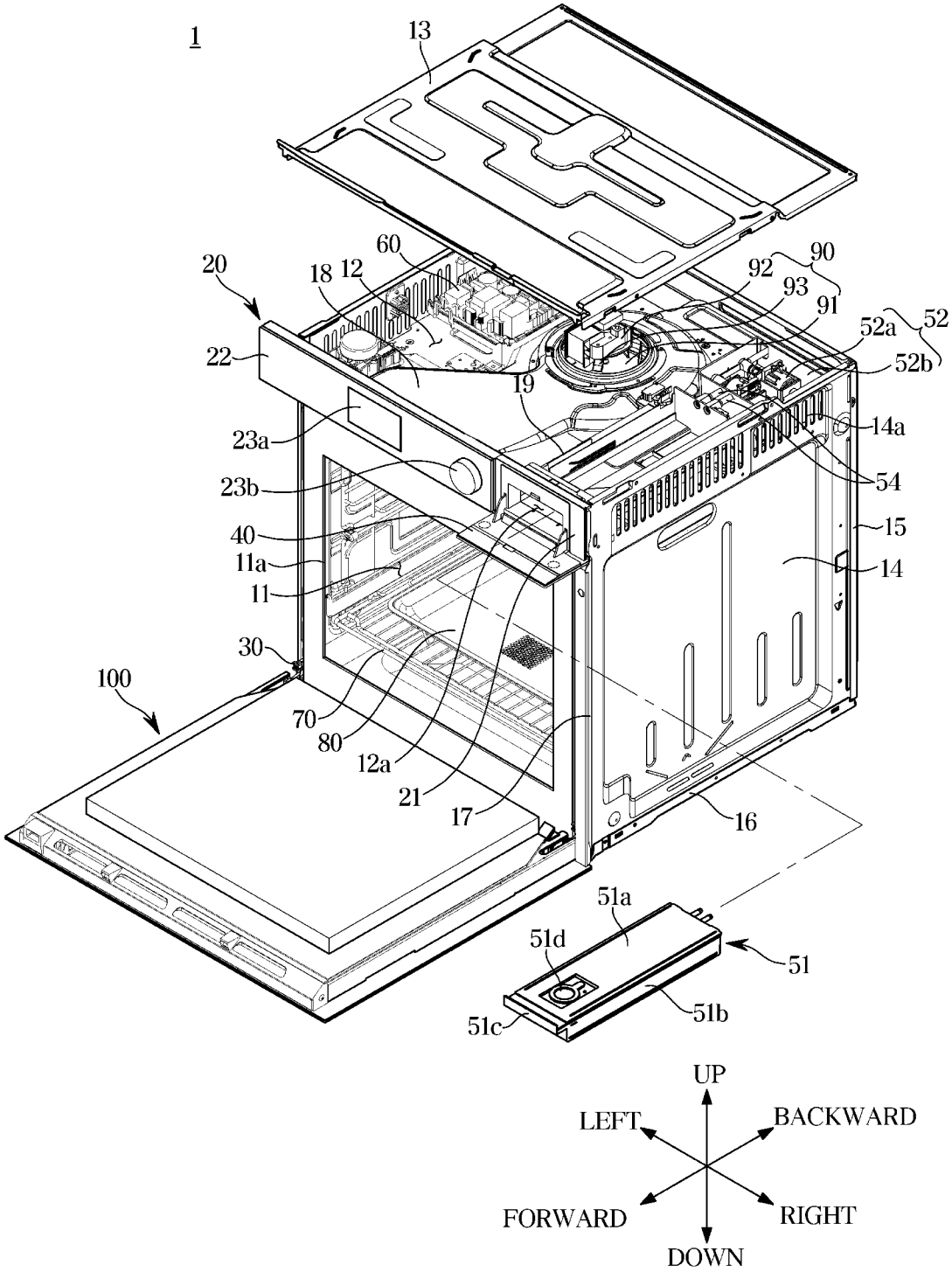
FIG. 2 shows a state of the cooking apparatus of FIG. 1 after an upper panel is separated from the cooking apparatus and a door opens.
Figure 3:
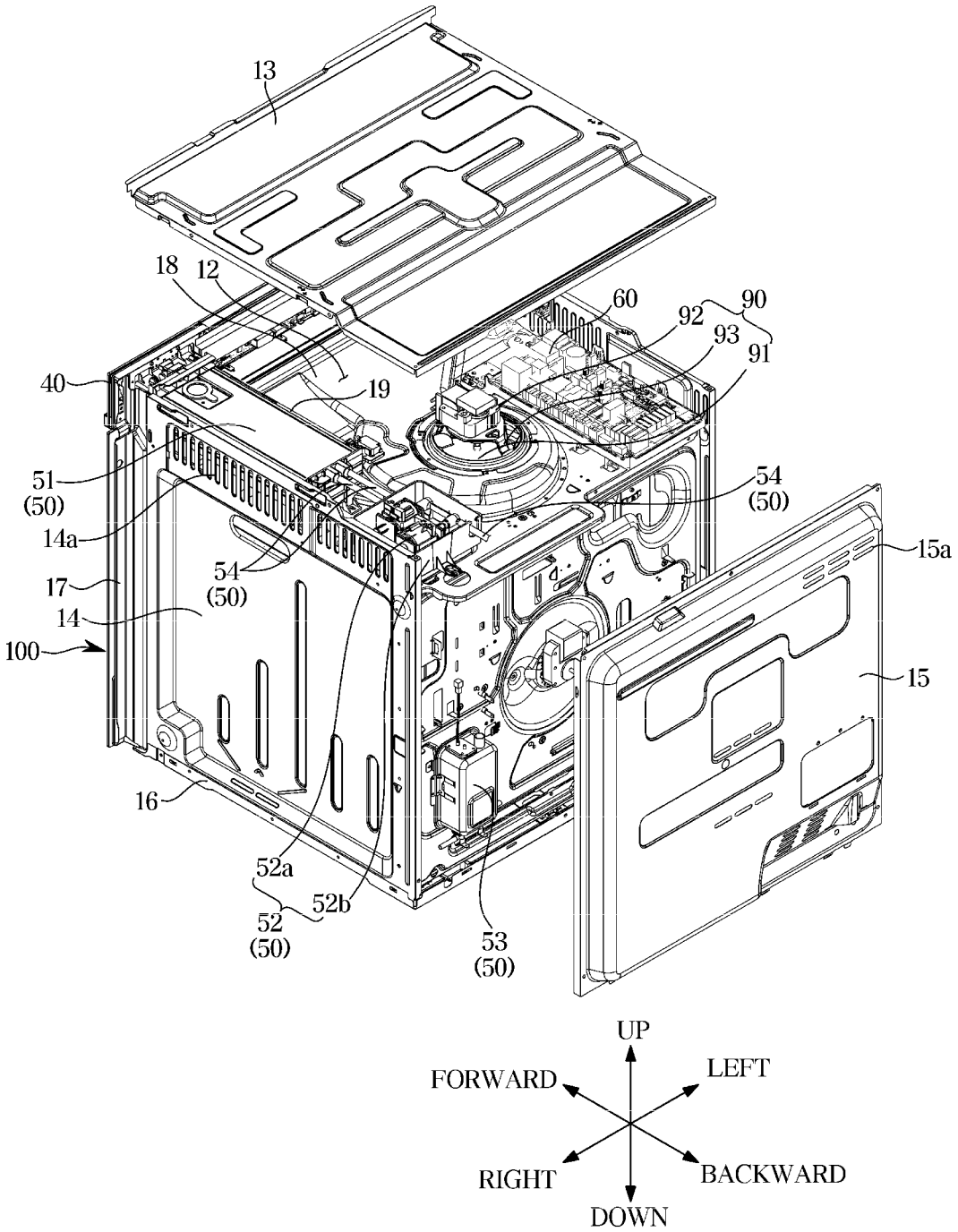
FIG. 3 shows a state of the cooking apparatus of FIG. 1 in a rear direction after the upper panel and a rear panel are separated from the cooking apparatus.

FIG. 1 is a perspective view of a cooking apparatus according to an embodiment of the disclosure. FIG. 2 shows a state of the cooking apparatus of FIG. 1 after an upper panel is separated from the cooking apparatus and a door opens. FIG. 3 shows a state of the cooking apparatus of FIG. 1 in a rear direction after the upper panel and a rear panel are separated from the cooking apparatus.

Referring to FIGS. 1 to 3, a cooking apparatus 1 may be installed inside a wall or a cabinet 2 to give a sense of unity with a kitchen space. That is, the cooking apparatus 1 may be a built-in type.

In at least one portion of a front side of the cabinet 2 in which the cooking apparatus 1 is installed, an opening may be formed, and the cooking apparatus 1 may be accommodated inside the cabinet 2 through the opening. The cooking apparatus 1 may be installed in the cabinet 2 or taken out of the cabinet 2 through the opening of the cabinet 2. For example, the cooking apparatus 1 may be taken out of the cabinet 2 by separating an upper panel 13 for repair, replacement of components, etc., which will be described below, although not limited thereto.

The cooking apparatus 1, which is a built-in type, may be accommodated in a cabinet (not shown) of which an upper side opens, unlike the cabinet 2 shown in FIG. 1. In this case, because the upper panel 13 of the cooking apparatus 1 is exposed upward, a user may perform a desired task by separating the upper panel 13 from the cooking apparatus 1 without taking the cooking apparatus 1 out of the cabinet of which the upper side opens. However, the cooking apparatus 1 may be not a built-in type, and in this case, likewise, the upper panel 13 of the cooking apparatus 1 may be exposed upward.

The cooking apparatus 1 may include a main body 10 forming an appearance of the cooking apparatus 1.

Inside the main body 10, a cooking room 11 in which food to be cooked is put and the food is cooked may be provided. In the main body 10, a first opening 11*a* through which food is put in or taken out of the cooking room 11 may be formed. Generally, a side of the cooking apparatus 1, in which the first opening 11*a* of the cooking room 11 is formed, may be defined as a front side of the cooking apparatus 1.

The main body 10 may include the upper panel 13, a side panel 14, a rear panel 15, and a base 16, forming an appearance of the cooking apparatus 1. Each of the upper panel 13, the side panel 14, the rear panel 15, and the base 16 may include a shape of a flat plate, although not limited thereto.

The upper panel 13 may be positioned in an upper portion of the main body 10 to form an upper surface of the cooking apparatus 1.

The side panel 14 may be provided as a plurality of pieces, and positioned in left and right sides of the main body 10 to form left and right surfaces of the cooking apparatus 1.

The rear panel 15 may be positioned in a rear portion of the main body 10 to form a rear surface of the cooking apparatus 1.

The base 16 may be positioned in a lower portion of the main body 10 to form a lower surface of the cooking apparatus 1. A front surface of the cooking apparatus 1 may be formed by a door 100, a control panel 20, and a steam door 40.

The upper panel 13, the side panel 14, the rear panel 15, and the base 16 may be detachably coupled to each other, although not limited thereto. However, some parts of the upper panel 13, the side panel 14, the rear panel 15, and the base 16 may be detachable from each other, and other parts may be integrated into one body. For example, only the upper panel 13 of the main body may be detachable, and the side panel 14, the rear panel 15, and the base 16 may be integrated into one body.

In the side panel 14 and the rear panel 15, a first radiating hole 14*a* and a second radiating hole 15*a* may be provided to radiate inside heat of an accommodating room 12, although not limited thereto. However, the first radiating hole 14*a* and the second radiating hole 15*a* may be formed in a portion of the side panel 14 and the rear panel 15.

The main body 10 may include a front frame 17 positioned on a front surface of the main body 10. The front frame 17 may cover at least one portion of the front surface of the main body 10, and may be formed in a shape of a frame including an opening. That is, the front frame 17 may be formed along a circumference of the first opening 11*a* of the cooking room 11.

A front surface of the front frame 17 may be covered by the door 100 upon closing of the door 100.

The front frame 17 may be positioned between the side panel 14 and the door 100 and between the side panel 14 and the control panel 20.

Inside the cooking room 11, a plate 80 on which food is put and a rack supporting the plate 80 may be provided. The plate 80 may have various shapes capable of accommodating food.

The rack 70 may be put in or taken out of the cooking room 11 through the first opening 11*a* of the cooking room 11. More specifically, the rack 70 may slide to be put in or taken out of the cooking room 11.

In addition, a heater (not shown) for supplying heat for cooking food, a steam inlet (not shown) through which a steam supplied from a steam supply device 50 which will be described below enters the cooking room 11, a cooking room fan (not shown) for smoothly circulating heat, a steam, etc. inside the cooking room 11, etc. may be provided inside the cooking room 11, although not limited thereto. However, various components may be provided inside the cooking room 11 according to purposes, functions, etc. of the cooking apparatus 1.

An inner surface of the cooking room 11 may be coated to prevent an inner wall of the cooking room 11 from being corroded by condensed water that may be generated during a condensation process of a steam, etc. and water included in food. The inner surface of the cooking room 11 may be dried by heat generated during a process of cooking food.

The cooking apparatus 1 may include the door 100 to open or close the cooking room 11. The door 100 may be rotatably coupled to the main body 10 to open or close the opening 11*a* of the cooking room 11.

The door 100 may be rotatably connected to the main body 10 by including a cooking room door hinge 30. The cooking room door hinge 30 may be coupled to both sides of a lower end of the main body 10 such that a rotation shaft of the door 100 is positioned in parallel to the lower end of the main body although not limited thereto.

However, there may be various methods in which the door 100 rotates with respect to the main body 10. For example, the cooking room door hinge 30 may be coupled to one side of the main body 10 in an up-down direction, and in this case, the rotation shaft of the door 100 may be positioned in parallel to the up-down direction of the main body 10.

A portion of the door 100 may be transparent to enable a user to look into the cooking room 11 while the door 100 is in a closed state. The transparent portion of the door 100 may include a heat-resistant glass material. However, a material of the transparent portion is not limited to the heat-resistant glass material.

The door 100 of the cooking apparatus 1 according to an embodiment of the disclosure may include no handle.

For example, the door 100 may be opened or closed manually by being pressed toward the main body 10 by a user. Alternatively, the door 100 may be opened or closed automatically by an electronic control.

The cooking apparatus 1 may include the accommodating room 12 separated from the cooking room 11. The accommodating room 12 may be provided inside the main body 10 and partitioned from the cooking room 11 by a partition 18.

Electronic components such as a main Printed Circuit Board (PCB) for performing functions of the cooking apparatus 1 may be accommodated inside the accommodating room 12. That is, the accommodating room 12 may include a machine room. The electronic components may be supported by the partition 18.

The electronic components including the main PCB 60 may receive power from an external power source by a wire (not shown) or may be connected to each other. The electronic components may receive power through a wire while transmitting/receiving an electrical signal to/from each other to perform functions of the cooking apparatus 1. For example, the steam supply device 50 may be connected to the main PCB 60, etc. by a wire to perform a function, although not limited thereto.

However, the accommodating room 12 may be provided separately from the machine room.

The accommodating room 12 may be provided in the upper portion of the main body 10. That is, the accommodating room 12 may be positioned above the cooking room 11. In this case, the upper panel 13 may be positioned in an upper area of the accommodating room 12 to form an upper surface of the accommodating room 12, and the partition 18 may be positioned in a lower area of the accommodating room 12 to form a lower surface of the accommodating room 12.

Because the accommodating room 12 is provided in the upper portion of the main body 10, a user may easily access the accommodating room 12 by separating the upper panel 13 from the side panel 14 and the rear panel 15, to perform a desired task.

For example, the user may repair or replace electronic components inside the accommodating room 12 only by separating the upper panel 13 from the side panel 14 and the rear panel 15.

Inside the accommodating room 12, a cooling fan module 90 for cooling heat generated from the electronic components such as the main PCB 60 may be provided. Components of the steam supply device 50, such as a steam pump module 52, may be positioned inside the accommodating room 12 and generate heat, and heat generated from the components may also be cooled by the cooling fan module 90.

The cooling fan module 90 may include a fan motor 92 and a cooling fan 91 that is rotatable by receiving power from the fan motor 92. According to a rotation of the cooling fan 91, an inside temperature of the accommodating room 12 may be lowered. The fan motor 92 may be supported by a motor bracket 93, and the motor bracket 93 may be fixed to the partition 18.

The cooking apparatus 1 may include the steam supply device 50 to supply a steam to the cooking room 11. The steam supply device 50 may include a steam container 51 positioned in the accommodating room 12 to store water for generating a steam, a steam generator 53 for receiving water stored in the steam container 51 and generating a steam, and the steam pump module 52 for supplying water stored in the steam container 51 to the steam generator 53.

The steam container 51 may form a water storage space (not shown) therein to store water for generating a steam.

In the steam container 51, an inlet (not shown) through which water is supplied into the steam container 51 may be provided. The steam container 51 may include a cap 51*d* to open or close the inlet, and a user may supply water into the steam container 51 by opening the cap 51*d*.

The inlet of the steam container 51 and the cap 51*d* for opening or closing the inlet may be provided in an upper portion of the steam container 51, although not limited thereto. However, the inlet of the steam container 51 and the cap 51*d* may be positioned at various locations of the steam container 51. For example, the inlet of the steam container 51 and the cap 51*d* for opening or closing the inlet may be provided in a front portion of the steam container 51.

The steam container 51 may include a steam container body 51*b* and a steam container cover 51*a* coupled to an upper portion of the steam container body 51*b*. An upper side of the steam container body 51*b* may open, and water may be stored in the steam container body 51*b*. The steam container cover 51*a* may be coupled to the upper portion of the steam container body 51*b* to cover the open upper side of the steam container body 51*b*. The above-described inlet and cap 51*d* of the steam container 51 may be provided in the steam container cover 51*a*.

The steam container cover 51*a* may be detachable from the steam container body 51*b*. Accordingly, a user may easily wash or dry the steam container 51 by detaching the steam container cover 51*a* from the steam container body 51*b*, although not limited thereto. However, the steam container 51 may be formed as one body, instead of being divided into the steam container cover 51*a* and the steam container body 51*b*.

At least one portion of the steam container 51 may be transparent to enable a user to check a residual amount of water stored in the steam container 51. For example, at least one portion of the steam container 51 may include a transparent plastic material.

The steam container 51 may include a ventilation hole (not shown) through which inside of the steam container 51 communicates with outside of the steam container 51 and air comes in and out. Upon a movement of water stored in the steam container 51 to the steam generator 53 by the steam pump module 52, inside pressure of the steam container 51 may be reduced and efficiency of the steam pump module 52 may be reduced in a case in which the steam container 51 is sealed. Accordingly, the steam container 51 may maintain constant inside pressure of the steam container 51 by including the ventilation hole for communication with outside air. The ventilation hole may be formed in the upper portion of the steam container 51, that is, in the steam container cover 51*a*, although not limited thereto.

A second opening 12*a* may be formed in the accommodating room 12. The steam container 51 may be taken out of or inserted into the accommodating room 12 through the second opening 12*a* of the accommodating room 12. The second opening 12*a* of the accommodating room 12 may be opened or closed by the steam door 40 which will be described below.

That is, the steam container 51 may be detachably installed in the accommodating room 12. As shown in FIG. 2, the second opening 12*a* of the accommodating room 12 may be formed in a front area of the accommodating room 12, and the steam container 51 may be taken out of the accommodating room 12 in a front direction and inserted into the accommodating room 12 in a rear direction through the second opening 12*a* of the accommodating room 12, although not limited thereto. However, directions in which the steam container 51 is taken out of or inserted into the accommodating room 12 are not limited to these. Also, the second opening 12*a* of the accommodating room 12 may be formed to correspond to the direction in which the steam container 51 is inserted into or taken out of the accommodating room 12, and the steam door 40 which will be described below may also be provided at a location at which the steam door 40 opens or closes the second opening 12*a* of the accommodating room 12.

The steam container 51 may include a gripping portion 51*c* which a user grips with his/her hand to take the steam container 51 out through the opening 12*a* of the accommodating room 12. The gripping portion 51*c* may be formed at one end of the steam container 51 in a direction in which the steam container 51 is taken out. More specifically, in a case in which the steam container 51 is taken out in the front direction from the accommodating room 12, as shown in FIG. 2, the gripping portion 51*c* may be provided at a front portion of the steam container 51.

By this configuration, the user may easily take the steam container 51 out of the accommodating room 12, supply water into the steam container 51, and then insert the steam container 51 into the accommodating room 12, although not limited thereto.

However, the steam container 51 may be not necessarily inserted into or taken out of the accommodating room 12. For example, in a state in which the steam container 51 is positioned inside the accommodating room 12, a user may add water in the steam container 51 by opening the steam door 40 and supplying water through the inlet (not shown) of the steam container 51. In this case, the inlet (not shown) through which water is supplied to the steam container 51 may be provided in a front side of the steam door 51.

Hereinafter, for convenience of description, a case in which the steam container 51 is taken out of or inserted into the accommodating room 12 through the second opening 12*a* of the accommodating room 12 will be described is assumed.

In the accommodating room 12, a fixing case 19 accommodating the steam container 51 may be provided. The fixing case 19 may be fixed inside the accommodating room 12, and the steam container 51 may be inserted or taken out with respect to the fixing case 19.

In other words, the fixing case 19 may be fixed with respect to the accommodating room 12, and the steam container 51 may be detachably installed in the fixing case 19. The fixing case 19 may be adjacent to the second opening 12*a* of the accommodating room 12 inside the accommodating room 12.

The fixing case 19 may cover at least one portion of an outer surface of the steam container 51. However, the fixing case 19 may not cover a side of the steam container 51 in which the second opening 12*a* of the accommodating room 12 is positioned such that the steam container 51 is inserted in or taken out of the accommodating room 12 through the second opening 12*a*.

An upper side of the fixing case 19 may open. That is, the upper side of the fixing case 19 may open such that the steam container cover Ma corresponding to the upper portion of the steam container 51 is exposed upward.

In other words, the fixing case 19 may be in a shape of a box of which a front side and an upper side open, although not limited. However, the fixing case 19 may also cover the upper surface of the steam container 51.

The fixing case 19 may communicate with the steam pump module 52 by a water supply tube 54. Also, the fixing case 19 may communicate with inside of the steam container 51 upon installation of the steam container 51 in the fixing case 19. In this case, upon insertion of the steam container 51 into the accommodating room 12, the steam container 51 may communicate with the steam pump module 52 through the fixing case 19.

According to accommodation of the steam container 51 by the fixing case 19, the steam container 51 may be easily guided to be inserted into or taken out of the accommodating room 12 compared to a case in which the fixing case 19 is not provided, and the steam container 51 may be stably supported even after being inserted in the accommodating room 12, although not limited thereto. However, the fixing case 12 may be not necessarily provided in the accommodating room 12.

The steam pump module 52 may generate pressure to supply water stored in the steam container 51 to the steam generator 53. The steam pump module 52 may communicate with the steam container 51 and the steam generator 53, and supply water stored in the steam container 51 to the steam generator 53.

The steam pump module 52 may include a steam pump 52*a* for generating pressure to move water and a pump housing 52*b* accommodating the steam pump 52*b*. The pump housing 52*b* may be fixed to the partition 18, although not limited thereto. The steam pump module 52 may include the pump housing 52*b*.

A plurality of steam pumps 52*a* may be provided. More specifically, a part of the plurality of steam pumps 52*a* may perform a function of supplying water stored in the steam container 51 to the steam generator 53, and at least another part may perform a function of returning water remaining after the steam generator 53 generates a steam to the steam container 51, although not limited thereto. However, the steam pump 52*a* may be provided alone.

The steam generator 53 may generate a steam by heating water supplied from the steam container 51 through the steam pump module 52. The steam generator 53 may include a heater (not shown) for heating supplied water, or receive heat from a heater (not shown) for supplying heat to the cooking room 11.

The steam supply device 50 may include the water supply tube 54 connecting components of the steam supply device 50 to each other to pass water through the components. For example, the water supply tube 54 may connect the components of the steam supply device 50 to supply water to the steam generator 53 from the steam container 51 via the steam pump 52*a* or return water remaining after a steam is generated to the steam container 51.

The steam supply device 50 may be connected to the electronic components such as the main PCB 60 through a wire (not shown) to receive power or transmit/receive an electrical signal. Particularly, the steam pump 52*a* and the steam generator 53 may be connected to the wire and receive power or transmit/receive an electrical signal to move water and generate or supply a steam.

However, the components of the steam supply device 50 is not limited to the above-described components, and the steam supply device 50 may include various components to generate a steam from water stored in the steam container 51 and supply the steam to the cooking room 11.

Inside the accommodating room 12, at least one part of the steam supply device 50, including the steam container 51, may be positioned. As shown in FIGS. 2 and 3, the steam container 51 and the steam pump module 52 may be positioned inside the accommodating room 12, and the steam generator 53 may be provided in the rear portion of the main body 10, although not limited thereto. However, the components of the steam supply device 50 may be positioned at various locations.

The accommodating room 12 may be separated from the machine room. In this case, the accommodating room 12 may indicate a space where only the steam supply device 50 is positioned or a space where the steam container 51 of the steam supply device 50 is positioned.

The cooking apparatus 1 may include a controller 23*b* for enabling a user to control a function of the cooking apparatus 1, and a display device 23*a* for displaying a state of the cooking apparatus 1 for the user. The display device 23*a* and the controller 23*b* may be provided on the front surface of the cooking apparatus 1 for a user's convenience, although not limited thereto.

The display device 23*a* and the controller 23*b* may be electrically connected to a control PCB (not shown). According to an input from a user who controls the controller 23*b*, an electrical signal may be transferred to the control PCB to control a function or operation of the cooking apparatus 1. The display device 23*a* may display various information, such as inside temperature of the cooking room 11, a cooking mode of food, etc., for a user.

The user may set a heating temperature of the cooking room 11 or a food cooking method such as a cooking mode by using the controller 23*b*. For example, the user may execute a steam cooking mode of food by using the controller 23*b*, and accordingly, the steam supply device 50 may perform the corresponding function. FIGS. 1 and 2 show a case in which the controller 23*b* is a dial-type physical controller. However, a kind of the controller 23*b* is not limited to this.

Meanwhile, the display device 23*a* may include a touch display panel. In this case, the display device 23*a* may receive a user's touch independently from the controller 23*b*.

The display device 23*a* and the controller 23*b* may be provided on the control panel 20, although not limited thereto.

Figure 4:
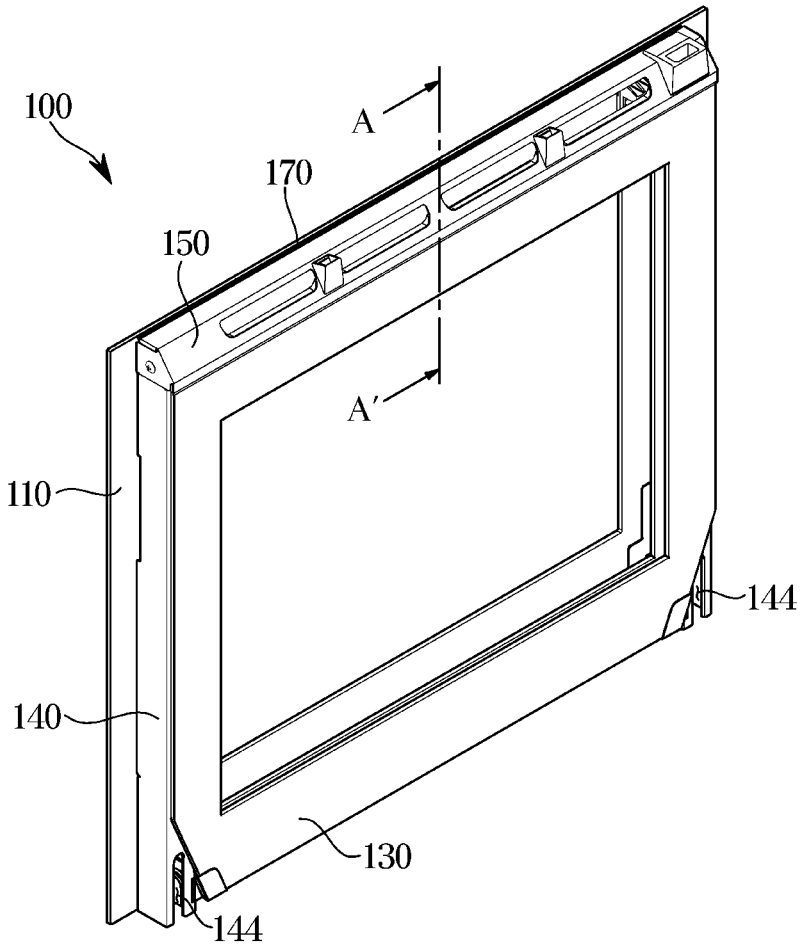
FIG. 4 shows a rear side of a door of a cooking apparatus according to an embodiment of the disclosure.
Figure 5:
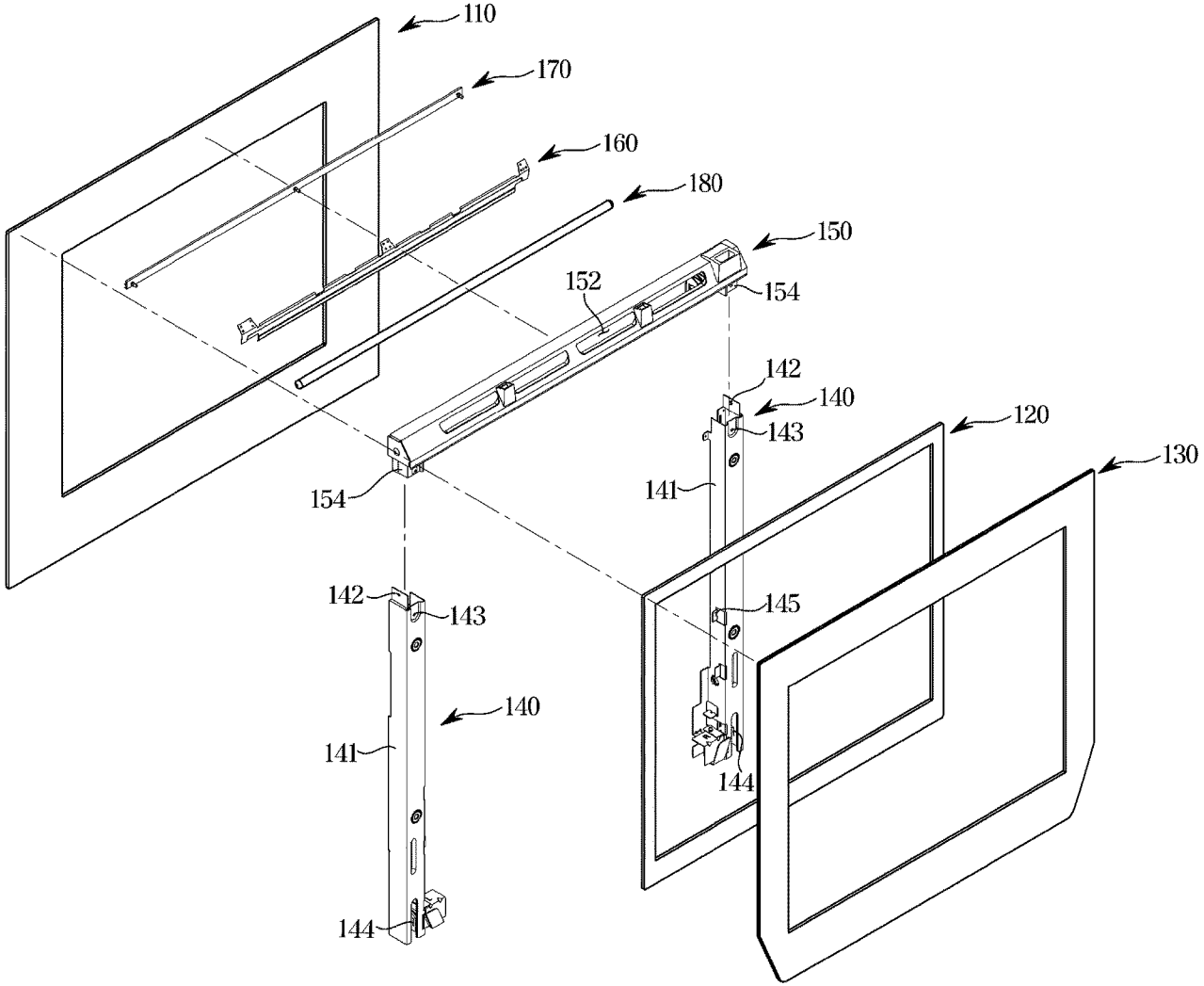
FIG. 5 is an exploded perspective view of the door shown in FIG. 4.

FIG. 4 shows a rear side of a door of a cooking apparatus according to an embodiment of the disclosure. FIG. 5 is an exploded perspective view of the door shown in FIG. 4.

Referring to FIGS. 4 and 5, the door 100 may be rotatably coupled to the main body 10 to open or close the cooking room 11.

The door 100 may include an outer glass 110.

The outer glass 110 may form a front appearance of the door 100. The outer glass 110 may be positioned on the same plane as the control panel 20. A surface of the outer glass 110 may be exposed to a user.

Edge portions of the outer glass 110 may be opaque, and a center portion of the outer glass 110 may be transparent. Accordingly, a user may look into the cooking room 11 from outside the cooking room 11.

The door 100 may include an inner glass 130.

The inner glass 130 may be positioned behind the outer glass 110 to face the cooking room 11.

An upper end portion of the inner glass 130 may be positioned between a door duct 150 and a duct bracket 160.

The door 100 may include a middle glass 120. The middle glass 120 may be positioned between the outer glass 110 and the inner glass 130. The middle glass 120 may be fixed in position by a door frame 140 behind the outer glass 110.

The middle glass 120 may reinforce an insulation function of the door 100 between the outer glass 110 and the inner glass 130. For example, the middle glass 120 may prevent heat of the inner glass 130 heated by heat generated in the cooking room 11 from being convected to the outer glass 110.

The cooking apparatus 1 according to an embodiment of the disclosure may include the outer glass 110, the middle glass 120, and the inner glass 130, as shown in FIG. 5. However, a number of glasses is not limited to three, and four or more glasses or two or less glasses may be provided.

The door 100 may include the door frame 140.

A pair of door frames 140 may be provided. The door frames 140 may be installed on a rear surface of the outer glass 110 to support the door duct 150 and the inner glass 130 at sides.

The door frame 140 may include a frame body 141. The door frame 140 may include a first duct fastening portion 142 and a second duct fastening portion 143 formed at an upper end of the frame body 141.

The first duct fastening portion 142 may extend upward from the frame body 141 and be inserted in a side body 1515 (which will be described below) of the door duct 150. The first duct fastening portion 142 may be coupled to the side body 1515 by a separate coupling member.

The second duct fastening portion 143 may be formed by being depressed inward from an upper end of a rear side of the frame body 141. The second duct fastening portion 143 may be coupled to a frame coupling portion 154 (which will be described below) of the door duct 150 by a separate coupling member. For example, the frame coupling portion 154 of the door duct 150 may be inserted into and coupled to an inner part of the second duct fastening portion 143.

The door frame 140 may include a hinge installing portion 144.

The hinge installing portion 144 may be formed at a lower end of the door frame 140. The hinge installing portion 144 may be formed by cutting a portion of the frame body 141 of the door frame 140. By inserting the cooking room door hinge 30 into the hinge installing portion 144, the door 100 may be coupled to the main body 10 in such a way as to be rotatable with respect to the main body 10.

The door frame 140 may include a glass supporting portion 145.

The glass supporting portion 145 may extend inward from the frame body 141 toward the middle glass 120. For example, the glass supporting portion 145 may support a rear surface of the middle glass 120. The glass supporting portion 145 may fix a position of the middle glass 120.

The door 100 may include the door duct 150.

The door duct 150 may be positioned between the outer glass 110 and the inner glass 130. The door duct 150 may guide air flowing between the outer glass 110 and the inner glass 130 to outside of the door 100.

The door duct 150 may be positioned at an upper portion of the rear surface of the outer glass 110.

For example, the outer glass 110 may be spaced from the inner glass 130 in a front-rear direction. A gap may be formed between the outer glass 110 and the inner glass 130. The gap formed between the outer glass 110 and the inner glass 130 may open at the lower end of the door 100.

Accordingly, outside air may enter the lower end of the door 100 and flow through inside of the door 100 to thereby prevent the door 100 from being heated by heat generated from the cooking room 11. More specifically, outside air entered the lower end of the door 100 may flow between the inner glass 130 and the outer glass 110 to reduce a phenomenon in which heat of the inner glass 130 directly influenced by heat of the cooking room 11 is convected to the outer glass 110.

Accordingly, outside air entered the lower end of the door 100 may be discharged to an upper end of the door 100. For example, outside air entered the lower end of the door 100 may be guided to the outside of the door 100 through a communicating hole 152 of the door duct 150 positioned in an upper portion of the door 100.

The door duct 150 may include a pair of frame coupling portions 154 that extend downward from both ends of the door duct 150 and are respectively coupled to the first duct fastening portion 142 and the second duct fastening portion 143 of the pair of the door frames 140.

The door duct 150 may extend along a left-right direction of the cooking apparatus 1 and be positioned behind the outer glass 110.

The door duct 150 may include a metal material, although not limited thereto. However, the door duct 150 may include a heat-resistant material capable of enduring a high-temperature environment. Details about the door duct 150 will be described below.

The door 100 may include the duct bracket 160.

The duct bracket 160 may be coupled to an inner surface of the door duct 150.

The duct bracket 160 may be coupled to the inner surface of the door duct 150 and extend to a front portion of the inner glass 130 to support a front portion of a blocking member 180.

The duct bracket 160 may include the same material as the door duct 150. For example, the duct bracket 160 may include a metal material.

The duct bracket 160 may be coupled to the door duct 150 by being welded onto the door duct 150. However, a method for coupling the duct bracket 160 is not limited to this. Details about the duct bracket 160 will be described below.

The door 100 may include the blocking member 180.

The blocking member 180 may be positioned between the door duct 150 and the inner glass 130 to prevent heat of the cooking room 11 from leaking out. The blocking member 180 may extend along the left-right direction of the cooking apparatus 1.

The blocking member 180 may include a glass fiber material. However, a material of the blocking member 180 is not limited to this, and may be a rubber material.

The blocking member 180 may be elastically deformable in shape.

The blocking member 180 may be in contact with an upper surface of the inner glass 130 to prevent heat of the cooking room 11 from leaking out. The blocking member 180 which is compressible may be positioned between the door duct 150 and the duct bracket 160.

For example, the blocking member 180 may prevent inside heat of the cooking room 11 from being convected to the outer glass 110 through the gap between the door duct 150 and the inner glass 130.

More specifically, because the inside of the cooking room 11 is at high temperature during a cooking process, the inner glass 130 may be bent. In this case, a gap may be formed between the door duct 150 and the inner glass 130 according to deformation in shape of the inner glass 130. Upon transfer of heat of the cooking room 11 to the outer glass 110 through the gap, a surface temperature of the outer glass 110 may rise.

Accordingly, the cooking apparatus 1 according to an embodiment of the disclosure may prevent a gap from being formed between the door duct 150 and the inner glass 130 by positioning the blocking member 180 between the door duct 150 and the inner glass 130. Details about this will be described below.

The door 100 may include an insulation member 170.

The insulation member 170 may be positioned between the door duct 150 and the outer glass 110. The insulation member 170 may prevent heat of the door duct 150 from being transferred to the outer glass 110. The insulation member 170 may be positioned behind the outer glass 110 to prevent the door duct 150 from being in direct contact with the outer glass 110.

The insulation member 170 may include a rubber material, although not limited thereto. However, the insulation member 170 may include a plastic material.

Details about the insulation member 170 will be described below.

Figure 6:
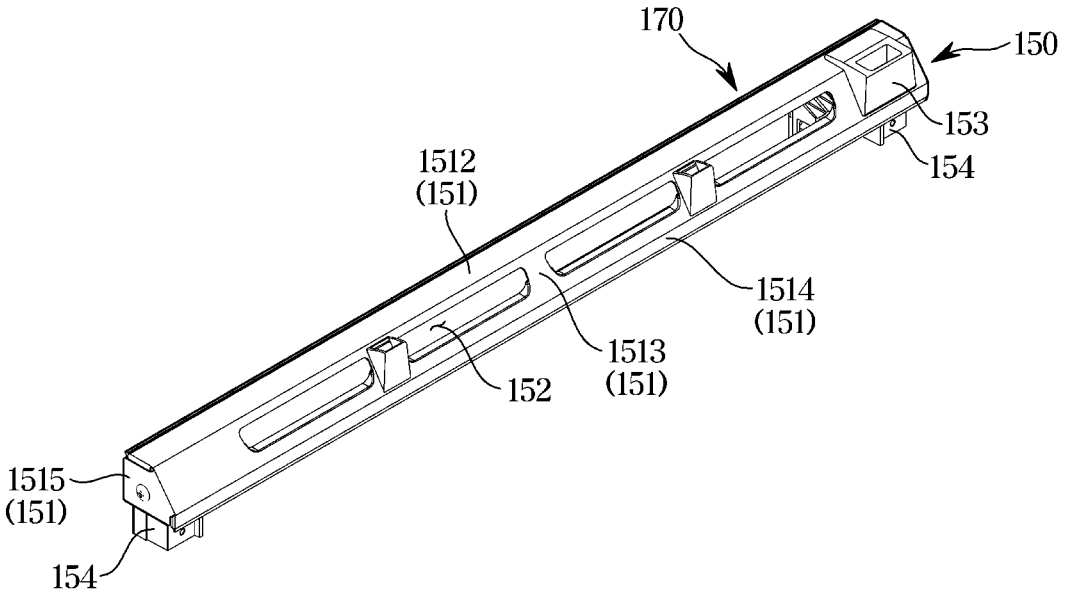
FIG. 6 shows a coupled state of a door duct, a duct bracket, an insulation member, and a blocking member in a cooking apparatus according to an embodiment of the disclosure, in the rear direction.
Figure 7:
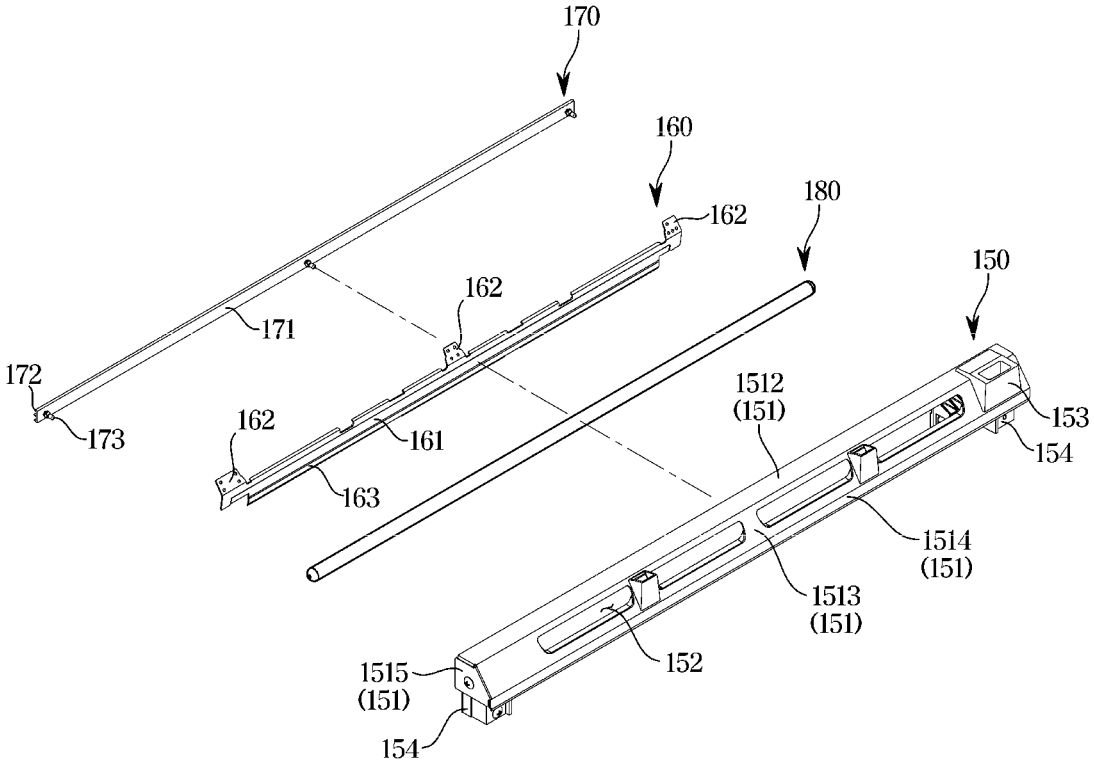
FIG. 7 is an exploded perspective view of components shown in FIG. 6.
Figure 8:
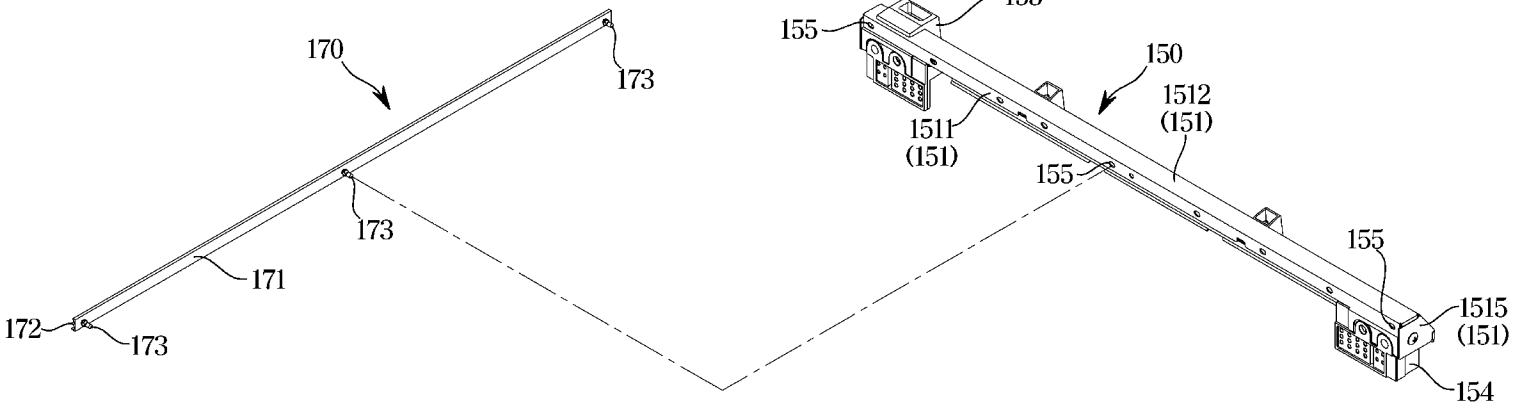
FIG. 8 is an exploded perspective view of the door duct and the insulation member shown in FIG. 7.
Figure 9:
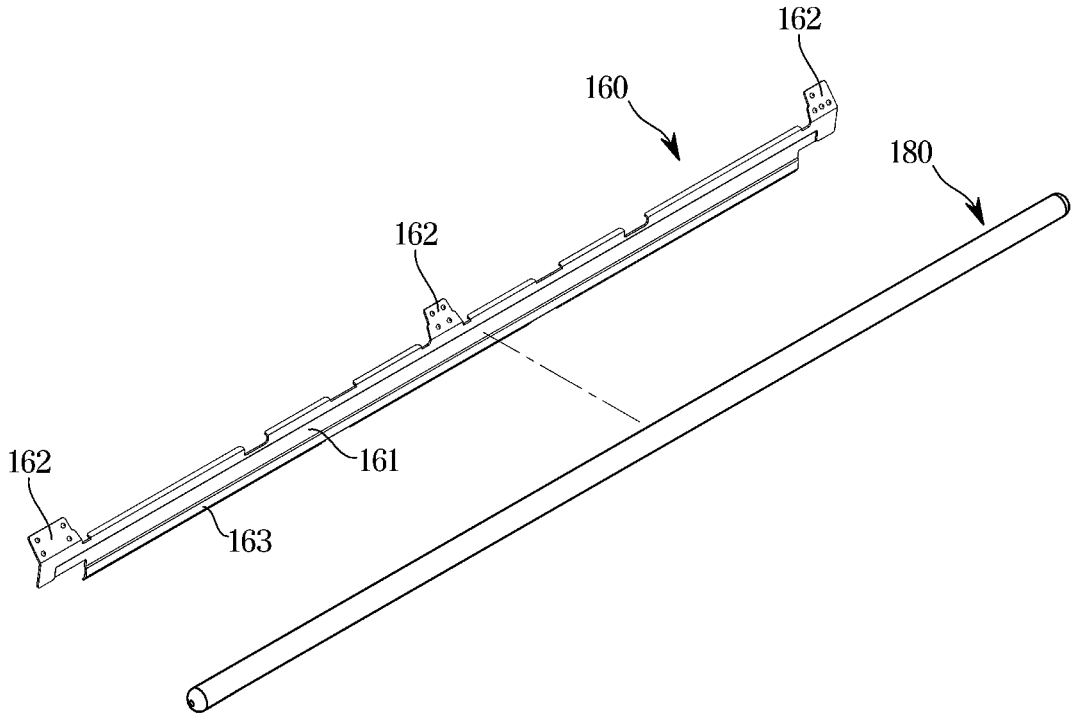
FIG. 9 is an exploded perspective view of the duct bracket and the blocking member shown in FIG. 7.

FIG. 6 shows a coupled state of a door duct, a duct bracket, an insulation member, and a blocking member in a cooking apparatus according to an embodiment of the disclosure, in the rear direction. FIG. 7 is an exploded perspective view of components shown in FIG. 6. FIG. 8 is an exploded perspective view of the door duct and the insulation member shown in FIG. 7. FIG. 9 is an exploded perspective view of the duct bracket and the blocking member shown in FIG. 7.

Referring to FIGS. 6 to 9, the door duct 150 may include a duct body 151. The duct body 151 may include a first body 1511, a second body 1512, a third body 1513, and a fourth body 1514.

The first body 1511 may be positioned in parallel to the outer glass 110 behind the outer glass 110. The second body 1512 may be bent from the first body 1511 to form an upper surface of the door duct 150. The third body 1513 may be bent from the second body 1512, wherein the communicating hole 152 through which air cooled the door 100 is discharged may be formed in the third body 1513. The fourth body 1514 may be bent from the third body 1513 and extend to a rear portion of the inner glass 130.

The duct bracket 160 may be coupled to an inner surface of the third body 1513 of the door duct 150.

The door duct 150 may include the side body 1515. The side body 1515 may form both side surfaces of the door duct 150.

The door duct 150 may include a latch inserting portion 153.

The latch inserting portion 153 may be positioned at one side of the door duct 150. The latch inserting portion 153 may include an open portion that opens upward. A separate locking device (not shown) may be inserted in the latch inserting portion 153 to prevent the door 100 from opening with respect to the main body 10.

The door duct 150 may include the frame coupling portion 154.

The frame coupling portion 154 may extend downward from both ends of the door duct 150. The frame coupling portion 154 may be inserted in inside of the door frame 140. The door duct 150 may be coupled to the door frame 140 through the frame coupling portion 154.

According to coupling of the door duct 150 to the door frame 140, the blocking member 180 positioned below the door duct 150 may be compressed between the inner glass 130 and the door duct 150.

The door duct 150 may include an insulation member inserting portion 155.

The insulation member inserting portion 155 may be formed in the first body 1511 positioned in parallel to the outer glass 110 behind the outer glass 110. The insulation member inserting portion 155 may be provided in a hole shape by cutting a portion of the first body 1511. A duct coupling protrusion 173 (which will be described below) of the insulation member 170 may be inserted in the insulation member inserting portion 155.

The duct bracket 160 may include a bracket body 161, a duct coupling flange 162, and a support flange 163.

The bracket body 161 may form an appearance of the duct bracket 160. The bracket body 161 may extend along the left-right direction of the cooking apparatus 1.

The duct coupling flange 162 may extend upward from the bracket body 161. The duct coupling flange 162 may be coupled to the third body 1513 of the door duct 150.

The support flange 163 may extend downward from the bracket body 161 and extend to the front portion of the inner glass 130. The support flange 163 may have a length corresponding to an extension length in left-right direction of the inner glass 130. The support flange 163 may support a front portion of the blocking member 180. The support flange 163 may be in contact with the blocking member 180.

The insulation member 170 may include an insulation body 171, an elastic rib 172, and a duct coupling protrusion 173.

The insulation body 171 may extend along the left-right direction of the cooking apparatus 1. The insulation body 171 may be positioned in parallel to the outer glass 110. The insulation body 171 may be positioned in parallel to the first body 1511 of the door duct 150. The insulation body 171 may be positioned between the rear surface of the outer glass 110 and the door duct 150.

The elastic member 172 may extend from the insulation body 171 in the front direction toward the outer glass 110. In FIG. 7, three elastic ribs 172 are shown. However, a number of the elastic ribs 172 is not limited to three, and various numbers of elastic ribs 172 may be provided.

The elastic rib 172 may be deformable in shape by an external force.

The duct coupling protrusion 173 may protrude from the insulation body 171 toward the rear direction to be inserted in the insulation member inserting portion 155 of the door duct 150. In FIGS. 7 and 8, three duct coupling protrusions 173 are shown. However, a number of the duct coupling protrusions 173 is not limited to three.

Figure 10:
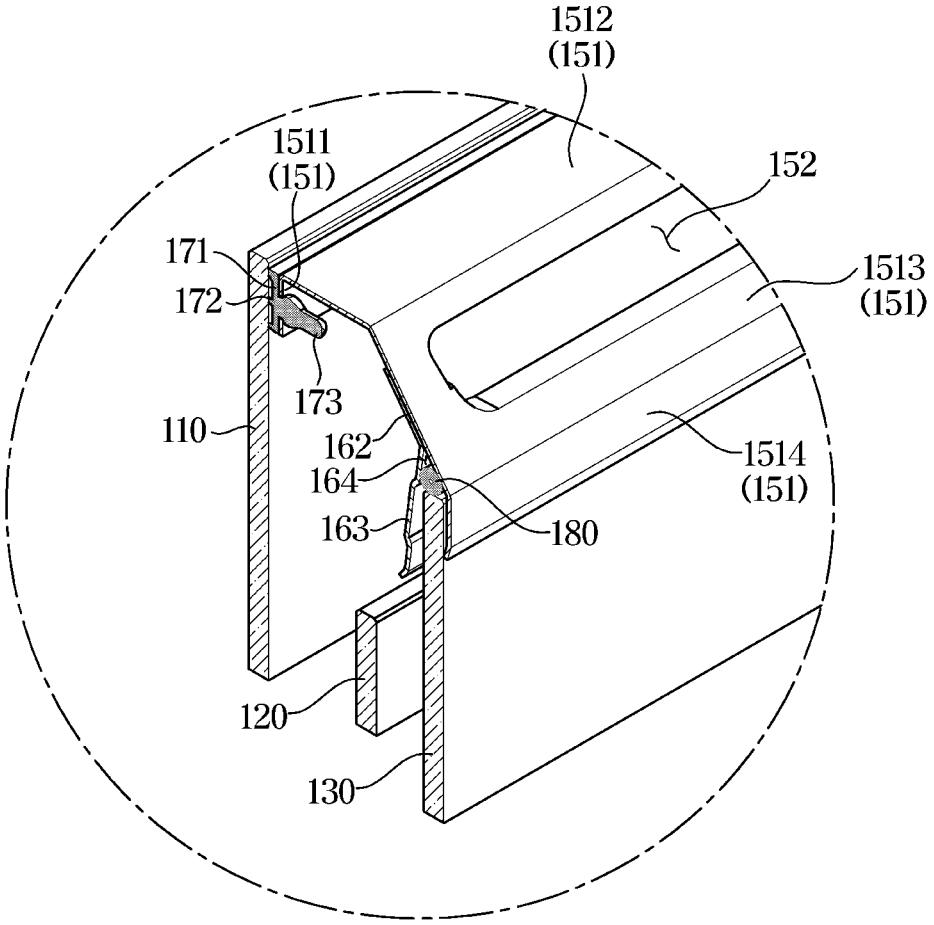
FIG. 10 is a cross-sectional perspective view taken along line A-A' of FIG. 4.
Figure 11:
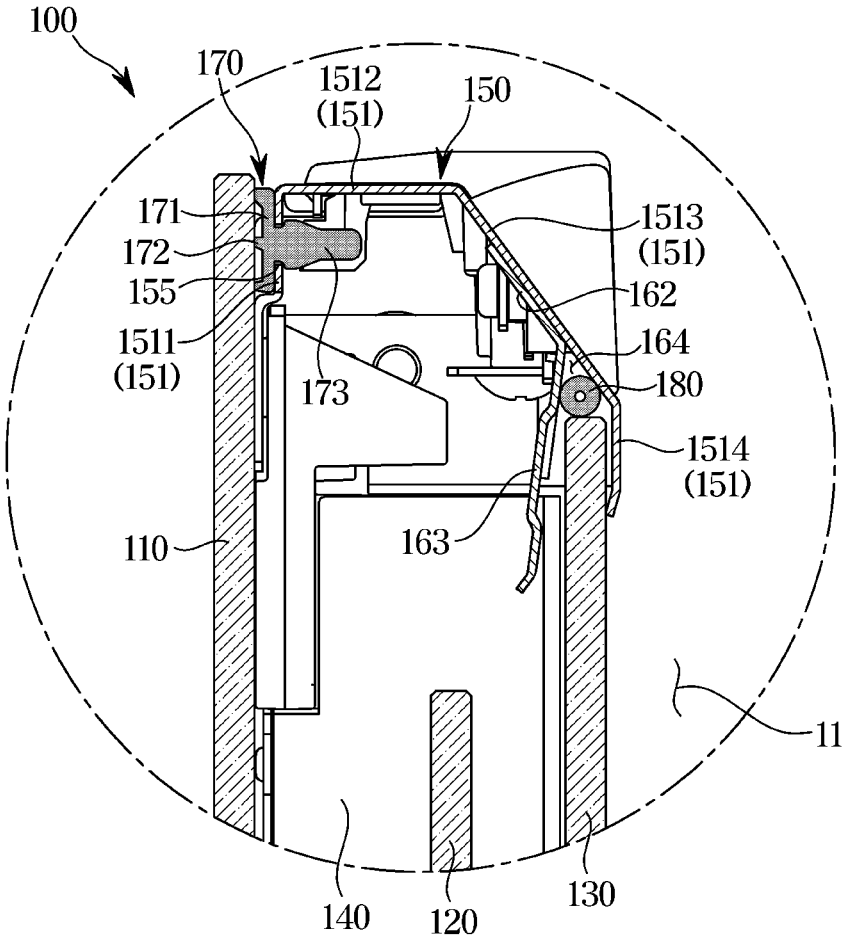
FIG. 11 is a cross-sectional view taken along line A-A' of FIG. 4.

FIG. 10 is a cross-sectional perspective view taken along line A-A' of FIG. 4. FIG. 11 is a cross-sectional view taken along line A-A' of FIG. 4.

A structure for maintaining a surface temperature of the door 100 according to an embodiment of the disclosure at a preset level or less will be described with reference to FIGS. 10 and 11.

As shown in FIGS. 10 and 11, the outer glass 110 may be positioned in front of the door duct 150, and the inner glass 130 may be positioned below the door duct 150 behind the door duct 150.

The middle glass 120 may be positioned between the outer glass 110 and the inner glass 130 to assist insulation performance of the door 100. The middle glass 120 may be supported by the door frame 140 at both sides and fixed in position.

Accordingly, air entered the door 100 from below the door 100 may flow upward along a space between the outer glass 110 and the middle glass 120 and a space between the middle glass 120 and the inner glass 130. The air moved upward may be discharged upward from the door 100 through the communicating hole 152 of the door duct 150.

The blocking member 180 may be positioned between the door duct 150 and the inner glass 130. More specifically, the blocking member 180 may be positioned between the door duct 150, the duct bracket 160, and the inner glass 130.

The cooking apparatus 1 may include a blocking member accommodating space 164. The blocking member accommodating space 164 may be formed between the third body 1513 of the door duct 150 and the support flange 163 of the duct bracket 160.

For example, the blocking member accommodating space 164 may be formed above the inner glass 130. Because an end portion of the door duct 150 extends behind the inner glass 130 and an end portion of the duct bracket 160 extends in front of the inner glass 130 with respect to the inner glass 130, the door duct 150 and the duct bracket 160 may respectively support front and rear portions of the blocking member 180.

More specifically, the duct coupling flange 162 of the duct bracket 160 may be coupled to the inner surface of the third body 1513 of the door duct 150 in a state of being parallel to the third body 1513. The support flange 163 of the duct bracket 160 may be bent from the duct coupling flange 162 and positioned in front of the inner glass 130.

Also, the blocking member 180 may be rested on the upper surface of the inner glass 130 and a lower portion of the blocking member 180 may be supported by the inner glass 130.

The first body 1511 of the door duct 150 may be in contact with the insulation body 171 of the insulation member 170. The duct coupling protrusion 173 of the insulation duct 170 may penetrate the first body 1511 toward inside of the first body 1511 through the insulation member inserting portion 155 formed in the first body 1511, and accordingly, the insulation member 170 may be fixed in position.

Accordingly, the duct coupling protrusion 173 of the insulation member 170 may penetrate the first body 1511 of the door duct 150 and be positioned below the second body 1512.

The elastic rib 172 of the insulation member 170 may be in contact with the rear surface of the outer glass 110. According to pressing-in of the insulation member 170 between the door duct 150 and the outer glass 110, the elastic rib 172 may be pressed and deformed in shape. Thereby, neither a gap between the outer glass 110 and the insulation member 170 nor a gap between the door duct 150 and the insulation member 170 may be formed.

The cooking apparatus 1 according to an embodiment of the disclosure may reduce heating of a surface of the door 100 by inside heat of the cooking room 11 by positioning the insulation member 170 in front of the door duct 150 and positioning the blocking member 180 between the door duct 150 and the inner glass 130.

According to an experimental example of the disclosure, upon a direct contact of the door duct 150 to the outer glass 110, a surface temperature of the door 100 may be 100 degrees or more.

However, by positioning the blocking member 180 in one side of the door duct 150 and positioning the insulation member 170 in another side of the door duct 150, a surface temperature of the door 100 may be maintained at 75 degrees or less. Preferably, the surface temperature of the door 100 may be about 72 degrees.

In a general case, a handle may be formed on an upper portion of a front surface of the door 100 because of the surface temperature of the door 100. However, because the disclosure secures a preset level of surface temperature or less of the door 100, no handle may need to be formed on the upper portion of the front surface of the door 100.

Also, a handle may be not necessarily formed on the upper portion of the front surface of the door 100.

Accordingly, a degree of freedom in designing the shape of the door 100 may be provided, and an esthetic sense of the door 100 and an esthetic sense in appearance of the cooking apparatus 1 may be improved.

Figure 12:
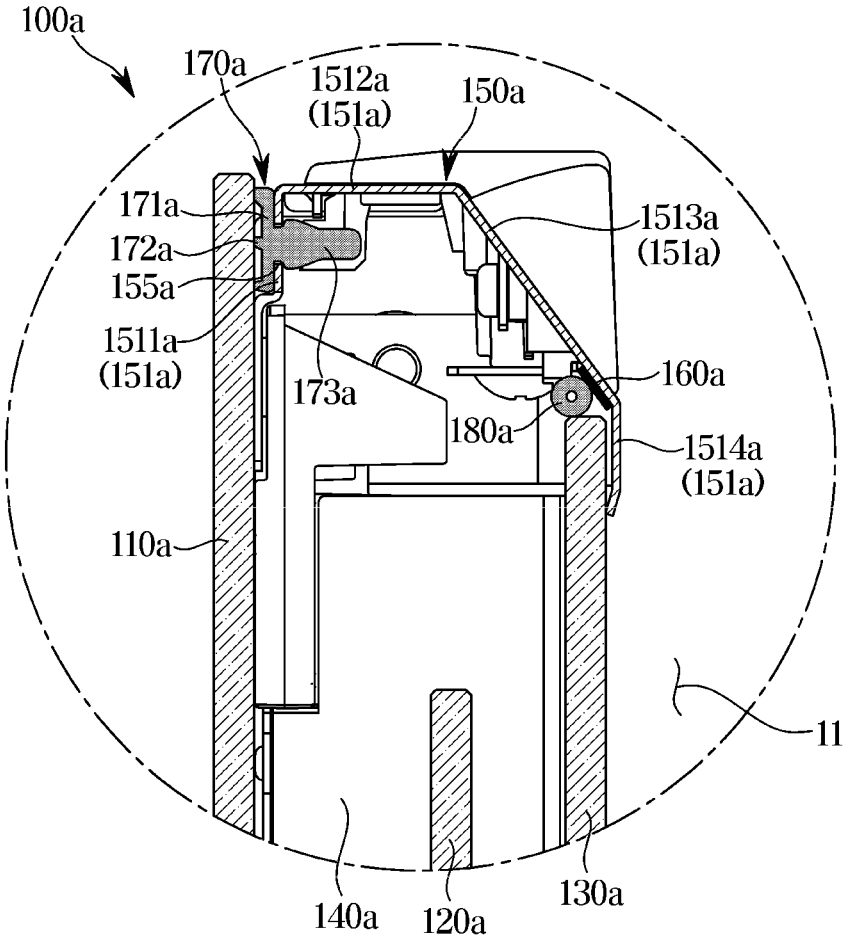
FIG. 12 is a cross-sectional view of a door of a cooking apparatus according to an embodiment of the disclosure.

FIG. 12 is a cross-sectional view of a door of a cooking apparatus according to an embodiment of the disclosure.

Referring to FIG. 12, an outer glass 110*a* may be positioned in front of a door duct 150*a*, and an inner glass 130*a* may be positioned below the door duct 150*a* behind the door duct 150*a*.

A middle glass 120*a* may be positioned between the outer glass 110*a* and the inner glass 130*a* to assist insulation performance of a door 100*a*. The middle glass 120*a* may be supported by the door frame 140 at both sides and fixed in position.

Accordingly, air entered the door 100*a* from below the door 100*a* may flow upward along a space between the outer glass 110*a* and the middle glass 120*a* and a space between the middle glass 120*a* and the inner glass 130*a*. The air moved upward may be discharged upward from the door 100*a* through a communicating hole of the door duct 150*a*.

A first body 1511*a* of the door duct 150*a* may be in contact with an insulation body of an insulation member 170*a*. A duct coupling protrusion 173*a* of the insulation member 170*a* may penetrate the first body 1511*a* toward inside of the first body 1511A through an insulation member inserting portion 155*a* formed in the first body 1511*a*, and accordingly, the insulation member 170*a* may be fixed in position.

Accordingly, the duct coupling protrusion 173*a* of the insulation member 170*a* may penetrate the first body 1511*a* of the door duct 150*a* and be positioned below a second body 1512*a*.

An elastic rib 172*a* of the insulation member 170*a* may be in contact with a rear surface of the outer glass 110*a*. According to pressing-in of the insulation member 170*a* between the door duct 150*a* and the outer glass 110*a*, the elastic rib 172*a* may be pressed and deformed in shape. Thereby, neither a gap between the outer glass 110*a* and the insulation member 170*a* nor a gap between the door duct 150*a* and the insulation member 170*a* may be formed.

A blocking member 180*a* may be positioned between the door duct 150*a* and the inner glass 130*a*.

Unlike the door 100 shown in FIGS. 1 to 11, the door 100*a* according to an embodiment of the disclosure, as shown in FIG. 12, may not include the duct bracket 160.

Instead, the door 100*a* according to an embodiment of the disclosure, as shown in FIG. 12, may include an adhesive member 160*a*.

The adhesive member 160*a* may be positioned on the door duct 150*a* such that a blocking member 180*a* is positioned on an upper surface of the inner glass 130*a* to seal a gap between the inner glass 130*a* and the door duct 150*a*. The adhesive member 160*a* may adhere the blocking member 180*a* to the door duct 150*a* to fix a position of the blocking member 180*a*.

For example, the blocking member 180*a* may be adhered to a third body 1513*a* of the door duct 150*a*.

The blocking member 180*a* may be rested on the upper surface of the inner glass 130*a* and a lower portion of the blocking member 180*a* may be supported by the inner glass 130*a*.

Figure 13:
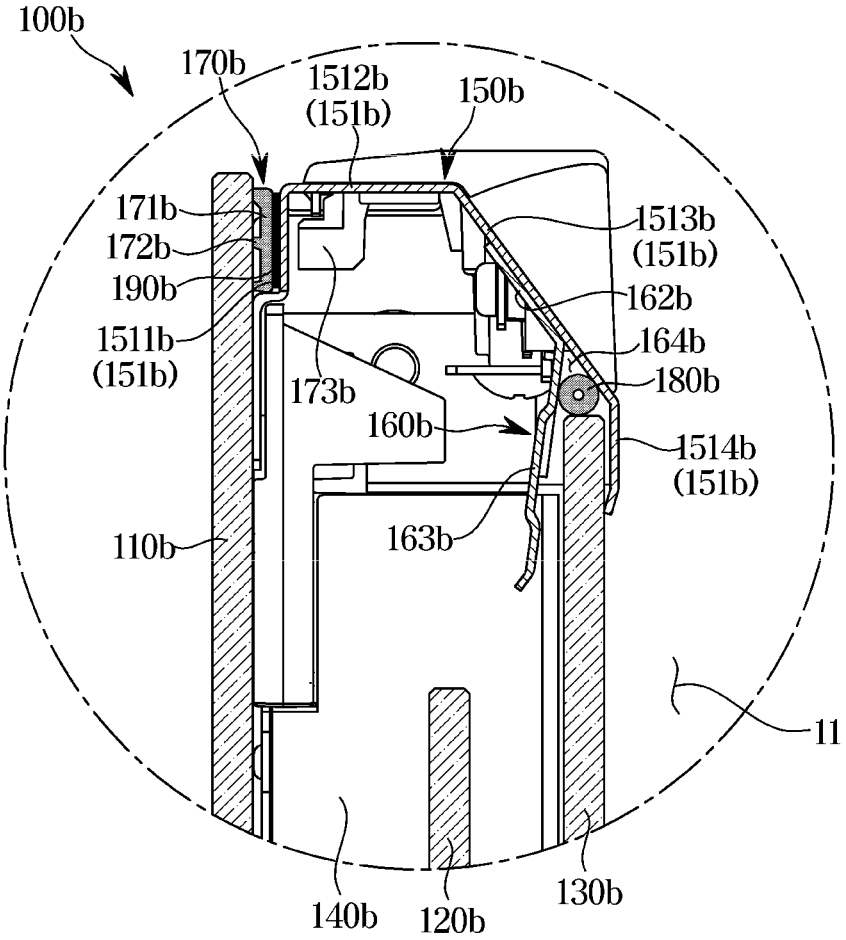
FIG. 13 is a cross-sectional view of a door of a cooking apparatus according to an embodiment of the disclosure.

FIG. 13 is a cross-sectional view of a door of a cooking apparatus according to an embodiment of the disclosure.

Referring to FIG. 13, an outer glass 110*b* may be positioned in front of a door duct 150*b*, and an inner glass 130*b* may be positioned below the door duct 150*b* behind the door duct 150*b*.

A middle glass 120*b* may be positioned between the outer glass 110*b* and the inner glass 130*b* to assist insulation performance of a door 100*b*. The middle glass 120*b* may be supported by a door frame 140*b* at both sides and fixed in position.

Accordingly, air entered the door 100*b* from below the door 100*b* may flow upward along a space between the outer glass 110*b* and the middle glass 120*b* and a space between the middle glass 120*b* and the inner glass 130*b*. The air moved upward may be discharged upward from the door 100*b* through a communicating hole of the door duct 150*b*.

A blocking member 180*b* may be positioned between the door duct 150*b* and the inner glass 130*b*. More specifically, the blocking member 180*b* may be positioned between the door duct 150*b*, a duct bracket 160*b*, and the inner glass 130*b*.

The cooking apparatus 1 may include a blocking member accommodating space 164*b*. The blocking member accommodating space 164*b* may be formed between a third body 1513*b* of the door duct 150*b* and a support flange 163*b* of the duct bracket 160*b*.

For example, the blocking member accommodating space 164*b* may be formed above the inner glass 130*b*. Because an end portion of the door duct 150*b* extends behind the inner glass 130*b* and an end portion of the duct bracket 160*b* extends in front of the inner glass 130*b* with respect to the inner glass 130*b*, the door duct 150*b* and the duct bracket 160*b* may respectively support front and rear portions of the blocking member 180*b*.

More specifically, a duct coupling flange 162*b* of the duct bracket 160*b* may be coupled to an inner surface of the third body 1513*b* of the door duct 150*b* in a state of being parallel to the third body 1513*b*. The support flange 163*b* of the duct bracket 160*b* may be bent from the duct coupling flange 162*b* and positioned in front of the inner glass 130*b*.

Also, the blocking member 180*b* may be rested on an upper surface of the inner glass 130*b* and a lower portion of the blocking member 180*b* may be supported by the inner glass 130*b*.

A first body 1511*b* of the door duct 150*b* may be in contact with an insulation body 171*b* of an insulation member 170*b*.

Unlike the door 100 shown in FIGS. 1 to 11, in the door 100*b* according to an embodiment of the disclosure, as shown in FIG. 13, no duct coupling protrusion may be formed in the insulation member 170*b*.

Instead, the door 100*b* according to an embodiment of the disclosure, as shown in FIG. 13, may include an adhesive member 190*b*. The adhesive member 190*b* may be positioned on the first body 1511*b* to adhere the insulation body 171*b* of the insulation member 170*b* to the door duct 150*b*. For example, the adhesive member 190*b* may be positioned in front of the first body 1511*b*.

In correspondence to this, no insulation member inserting portion may be formed in the door duct 150*b* of the door 100*b* according to an embodiment of the disclosure, as shown in FIG. 13.

An elastic rib 172*b* of the insulation member 170*b* may be in contact with a rear surface of the outer glass 110*b*. According to pressing-in of the insulation member 170*b* between the door duct 150*b* and the outer glass 110*b*, the elastic rib 172*b* may be pressed and deformed in shape. Thereby, neither a gap between the outer glass 110*b* and the insulation member 170*b* nor a gap between the door duct 150*b* and the insulation member 170*b* may be formed.

The embodiments of the disclosure are not limited to the above-described examples, and the embodiments may be combined with each other.

So far, specific embodiments have been shown and described, however, the disclosure is not limited to these embodiments. It should be interpreted that various modifications may be made by one of ordinary skill in the technical art to which the disclosure belongs, without deviating from the gist of the technical concept of the disclosure, which is defined in the following claims.

What is claimed is:

1. A cooking apparatus comprising:

a main body that includes a cooking room in which an opening is formed at a front side of the cooking room, the opening configured to be capable of allowing food to be put in and taken out of the cooking room through the opening, and to contain heat for cooking the food; and a door rotatably coupled to the main body at a front side of the opening and configured to open or close the opening, the door including:

an outer glass that forms a front side of the door, an inner glass positioned behind the outer glass to face the cooking room, a door duct positioned between the outer glass and the inner glass such that the door duct forms an accommodating space below the door duct and above the inner glass, and configured to guide air flowing between the outer glass and the inner glass to outside of the door, an insulation member positioned between the door duct and the outer glass, and a blocking member positioned in the accommodating space formed between the door duct and the inner glass and configured to prevent heat contained in the cooking room from leaking out from between the inner glass and the door duct.

2. The cooking apparatus of claim 1, wherein the door duct includes:

a first body positioned parallel to and behind the outer glass;

a second body bent from the first body and forming an upper surface of the door duct;

a third body bent from the second body and formed with a communication hole configured so that air flowing between the outer glass and the inner glass is discharged outside the door; and a fourth body bent from the third body and extending to a rear portion of the inner glass.

3. The cooking apparatus of claim 2, wherein the door further includes a duct bracket coupled to an inner surface of the third body of the door duct.

4. The cooking apparatus of claim 3, wherein the duct bracket includes:

a bracket body, a duct coupling flange extending upward from the bracket body and coupled to the third body of the door duct, and a support flange extending downward from the bracket body and extending to a front portion of the inner glass.

5. The cooking apparatus of claim 4, wherein the third body of the door duct and the support flange are configured to form the accommodating space.

6. The cooking apparatus of claim 4, wherein the duct bracket further includes a metal material configured to be welded onto the door duct.

7. The cooking apparatus of claim 1, wherein the door further includes an adhesive member positioned on the door duct and configured to adhere the blocking member to the door duct so that the blocking member is positioned on an upper surface of the inner glass to seal a gap between the inner glass and the door duct.

8. The cooking apparatus of claim 1, wherein the insulation member includes:

an insulation body, and an elastic rib extending from the insulation body in a frontward direction toward the outer glass.

9. The cooking apparatus of claim 8, wherein the door duct includes:

a first body positioned parallel to and behind the outer glass, and an insulation member inserting portion formed in the first body, and wherein the insulation member includes a duct coupling protrusion protruding from the insulation body toward a rear direction and configured to be inserted in the insulation member inserting portion.

10. The cooking apparatus of claim 8, wherein the door duct includes a first body positioned parallel to and behind the outer glass, and the door further includes an adhesive member positioned on the first body and configured to adhere the insulation body to the door duct.

11. The cooking apparatus of claim 1, wherein the door further includes a door frame on a side of the door on a rear surface of the outer glass and configured to support the door duct and the inner glass at the side.

12. The cooking apparatus of claim 11, wherein the door duct includes frame coupling portions respectively extending downward from each end of the door duct, and the door frame includes a duct fastening portion configured to be coupled to each end of the frame coupling portions, and wherein when the duct fastening portion is coupled to each frame coupling portion of the frame coupling portions, the blocking member is compressed between the inner glass and the door duct.

13. The cooking apparatus of claim 1, wherein the door is not formed with a handle.

14. The cooking apparatus of claim 1, wherein the blocking member includes a glass fiber material.

* * * * *